United States Patent [19]

Simmler

[11] 4,382,401

[45] May 10, 1983

[54] AIR DISTRIBUTION APPARATUS, ESPECIALLY FOR OVERSATURATED AIR

[75] Inventor: Paul Simmler, Meilen, Switzerland

[73] Assignee: Luwa AG, Zürich, Switzerland

[21] Appl. No.: 177,639

[22] Filed: Aug. 13, 1980

[30] Foreign Application Priority Data

Sep. 13, 1979 [CH] Switzerland ..... 8289/79

[51] Int. Cl.[3] ..... F24F 13/06

[52] U.S. Cl. ..... 98/40 C; 98/40 N; 138/115; 239/122; 239/553.5

[58] Field of Search ..... 98/40 C, 40 N, 40 D; 239/120, 121, 122, 553.5, 566; 138/115, 116

[56] References Cited

U.S. PATENT DOCUMENTS

| | | | |
|---|---|---|---|
| 261,189 | 7/1882 | Walker | 138/116 |
| 1,592,718 | 7/1926 | Browne | 98/40 C X |
| 1,707,696 | 4/1929 | Walker | 239/121 |
| 2,350,514 | 6/1944 | Livar | 98/40 C |

FOREIGN PATENT DOCUMENTS

| | | | |
|---|---|---|---|
| 560821 | 10/1932 | Fed. Rep. of Germany | 98/40 N |
| 1102371 | 3/1961 | Fed. Rep. of Germany | 98/40 N |
| 1031767 | 6/1953 | France | 98/40 C |
| 284 | of 1803 | United Kingdom | 239/122 |

*Primary Examiner*—Albert J. Makay
*Assistant Examiner*—Harold Joyce
*Attorney, Agent, or Firm*—Werner W. Kleeman

[57] ABSTRACT

In the openings at the side wall of an infeed or inflow channel there are inserted outlet or discharge elements having an oval cross-section which continuously tapers in the flow direction. The inlet-side portion of the outlet elements, protruding into the interior of the infeed channel, possesses an outwardly drawn or flexed end portion or section which terminates in spaced relation from the channel side wall and forms therewith a catch trough. Within this trough there is entrapped water which is deposited at the inner surface or wall of the infeed channel and which flows downwardly along the channel side wall. At the outlet side of each outlet or discharge element there is arranged a further catch trough which extends at the inner surface of the outlet side or opening along the circumference. This inwardly open catch trough is formed by an end portion or section of the outlet element which is flexed or bent back towards the inside. By means of this catch trough the water which has been separated at the inner surface of the outlet element is prevented from reaching the region of the outlet opening. The base portion of the outlet element is constructed as a collecting trough which returns the separated water back into the interior of the infeed channel. Without the need to provide the outlet element with water separation elements arranged in the flow cross-section, there is avoided the exit of large water droplets out of the outlet or discharge elements.

14 Claims, 10 Drawing Figures

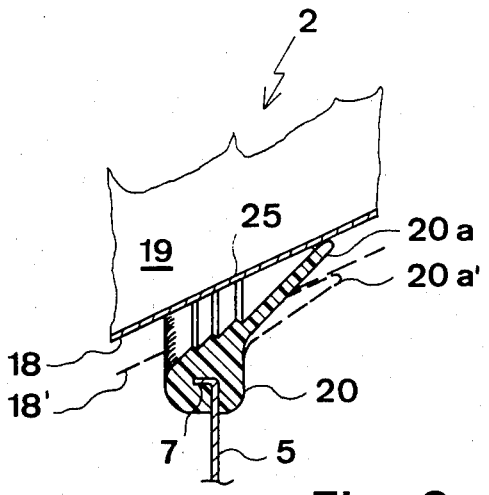
Fig. 9
Fig. 10
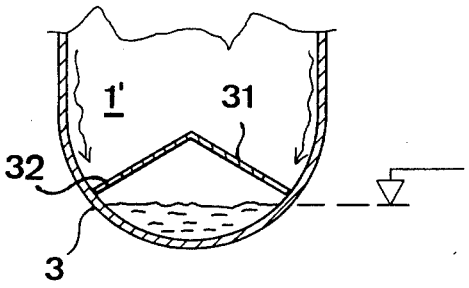

AIR DISTRIBUTION APPARATUS, ESPECIALLY FOR OVERSATURATED AIR

BACKGROUND OF THE INVENTION

The present invention relates to a new and improved construction of an air distribution apparatus, especially for oversaturated air.

Generally speaking, the air distribution apparatus of the present development is of the type comprising an infeed channel which is provided at least at one side thereof with outlet or discharge elements distributed over the length of the infeed channel. These outlet elements are provided at their base portion with a withdrawal line for the separated water.

There are known to the art different constructions of air distributor apparatuses, as exemplified for instance by German patent publication No. 2,801,082, Swiss Pat. No. 549,187, Swiss Pat. No. 582,338, Swiss Pat. No. 584,872 and the corresponding British patent specification No. 1,527,907. In Swiss Pat. No. 469,950 there is taught to the art a distributor apparatus of the aforementioned type wherein internally of the prismatic outlet or discharge elements there are arranged adjacent one another sheet metal droplet separation plates between which there are formed flow channels for the effluxing oversaturated air. At such separation plates there are separated the water droplets contained in the airflow. However, at such separation plates there are not only deposited the large water droplets, the discharge of which is undesired, but also small water droplets which should pass through the outlet elements into the area or room which is to be climatized. Additionally, due to the separation plates which span the inner width of the outlet or discharge elements there is impaired the flow of the air.

SUMMARY OF THE INVENTION

Therefore, with the foregoing in mind it is a primary object of the present invention to provide a new and improved construction of air distribution apparatus, especially for oversaturated air, which is not associated with the aforementioned drawbacks and limitations of the prior art discussed in detail above.

Another and more specific object of the present invention aims at providing a new and improved construction of distribution apparatus of the previously mentioned type, wherein the airflow is not essentially disturbed by structure incorporated into the apparatus, and furthermore, wherein there is prevented on undesired separation of water droplets without having to accept the efflux of large droplets which, following movement through their outlets, would otherwise tend to deposit upon, for instance, machines, apparatuses, goods and so forth.

Still a further significant object of the present invention is directed to a new and improved construction of air distribution apparatus which is relatively simple in design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the air distribution apparatus of the present development is manifested by the features that the outlet or discharge elements, possessing a free flow cross-section, are provided with a catch element for preventing the exit of water which has deposited upon their inner surface or side. Each such catch element extends along the periphery of its related outlet opening of the related outlet or discharge element. Additionally, each outlet or discharge element is provided with a collecting trough formed by its base or bottom portion. Such collecting trough serves for withdrawing the eliminated water and descends towards the interior of the channel.

By virtue of the catch elememt provided at the outlet side of each outlet or discharge element, there is avoided that water which deposits upon the inner surface of the outlet element will be entrained by the outflowing air. By means of this catch element the water is in fact entrapped and prevented from effluxing out of the outlet opening. Both the water which has been separated at the inner wall of the outlet element and also the water caught by the catch element flows as a film to the base portion, collects at the collecting trough and is returned back into the interior of the infeed channel due to the inclination of such collecting trough. Since there are absent water separation elements which are arranged in the flow cross-section, the air can flow through the outlet or discharge elements without being hindered, and without however large water droplets being carried out along with the air. The small water droplets, which remove heat from the ambient air so that they are evaporated, however, can efflux into the room or area which is to be climatized.

According to a further feature of the invention there extends along at least the upper portion of each opening of the channel wall a catch trough which is arranged at the inner surface or side of the channel and serves to catch the water which has deposited at the channel inner wall. Due to the provision of these catch troughs along each outlet opening in the wall of the inflow channel, there is prevented that water droplets which have deposited at the channel inner wall will reach the airflow and will be outwardly conveyed through the outlet elements by such airflow.

Preferably, the ceiling portion of the infeed channel is inclined towards one or both channel sides, so that water which has deposited at the ceiling portion in the form of a film can flow downwardly along the inner surface of the channel. There is prevented in this way the formation of large droplets at the channel ceiling, which otherwise might be entrained by the airflow and carried towards the outside.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 9 shows a resilient tongue of a profile element; and

FIG. 10 shows a cover with a throughpass means.

DETAILED DESCRIPTION OF THE PREFERRED EMBODIMENTS

Figure 1:
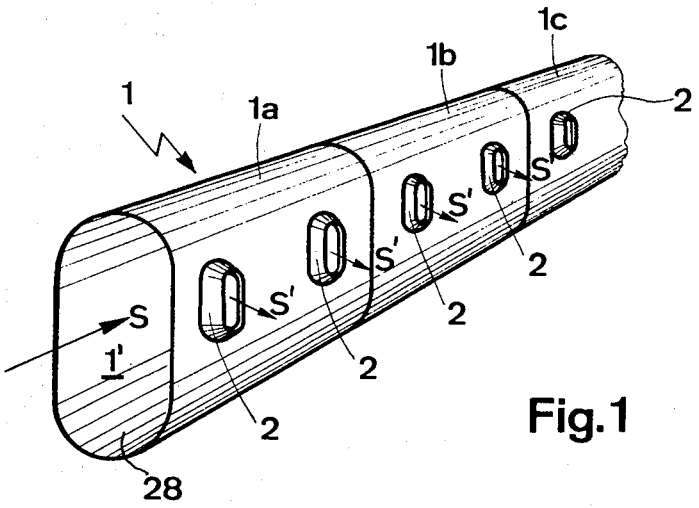
FIG. 1 is a simplified illustration of part of an air distribution apparatus in perspective view.
Figure 2:
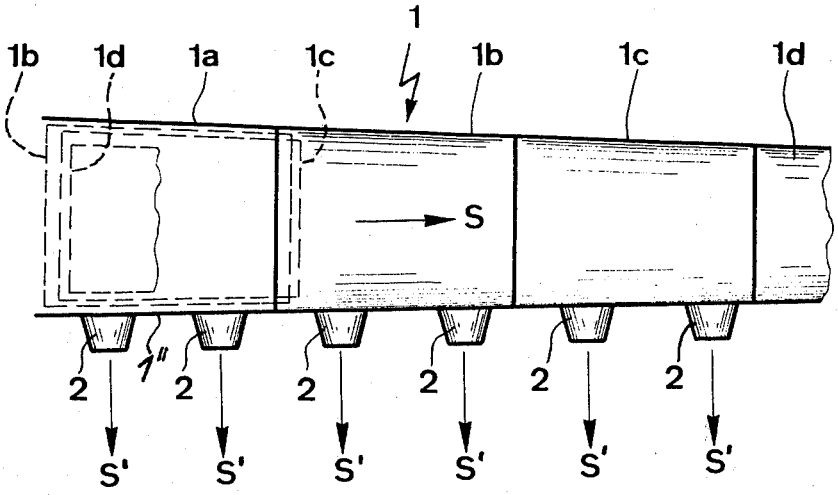
FIG. 2 is a top plan view of the air distribution apparatus shown in FIG. 1.

Describing now the drawings, based upon the showing of FIGS. 1 and 2, which illustrate in markedly simplified illustration a distributor apparatus for oversaturated air, there initially will be explained the basic construction of such distributor or distribution apparatus. This apparatus will be seen to comprise an air infeed channel 1 having an upwardly erected oval cross-section and tapering in the flow direction S of the oversaturated air. The throughflow cross-section continuously decreases in the throughflow direction S in accordance with the reduced quantity of air. The infeed channel 1 consists of individual channel sections 1*a*, 1*b*, 1*c* and 1*d*, which, in a manner to be more fully explained hereinafter, are appropriately connected with one another at their joints or joint locations. At the one side of the infeed channel 1 there are arranged a number of outlet or discharge elements 2 which are distributed over the length of such infeed channel 1. These outlet elements 2 flow communicate with the channel interior 1' and the oversaturated air flows through the outlet elements 2 in the direction of the arrow S' into the room or area which is to be climatized. The construction of such outlet or discharge elements 2 and their attachment at the channel wall 1'' will be described more fully hereinafter in conjunction with FIGS. 7 and 8. It should be understood that it is possible to provide at both sides of the infeed channel 1 such outlet or discharge elements 2.

Based upon the showing of FIGS. 3 to 6 there will be described hereinafter the construction of the infeed channel 1 and its individual channel sections or portions 1*a* to 1*d*. As particularly well seen by referring to FIG. 3, each channel section 1*a* to 1*d* is formed by a domed or curved base or floor portion 3, a likewise domed ceiling portion 4 and two essentially flat or planar side wall portions 5. All of these channel portions 3, 4 and 5 are advantageously constituted by metal parts, preferably sheet metal parts, which can be interconnected with one another by fold or bend connections 6. In order to obtain the previously mentioned tapering or constriction of the infeed channel 1, the base portion 3 and the ceiling portion 4 possess the shape of a jacket section of a truncated cone, preferably a circular truncated cone. At one of the side wall portions 5 there are provided openings 7 in which there are placed the outlet or discharge elements 2.

Figure 3:
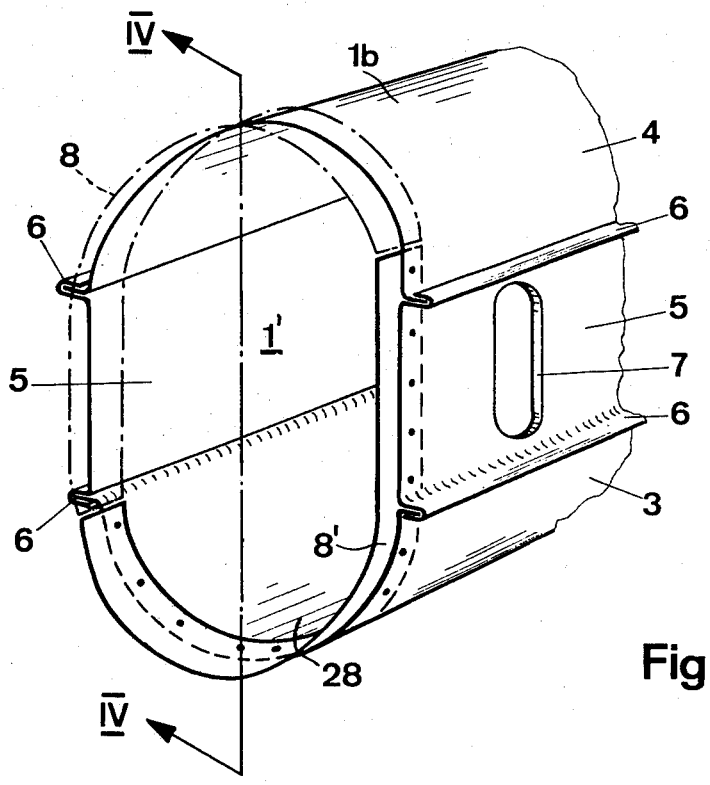
FIG. 3 is a perspective view of part of a section of the infeed channel.
Figure 4:
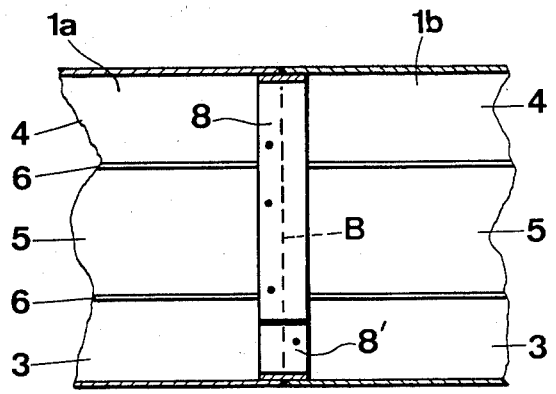
FIG. 4 is a sectional view of the arrangement of FIG. 3, taken substantially along the line IV—IV thereof.

As will be apparent from FIGS. 3 and 4, the individual channel portions or sections 1*a*, 1*b*, 1*c* and 1*d* are interconnected with one another by means of a suitable plug connection 8, 8'. For this purpose, at each end of the channel sections 1*a*, 1*b*, 1*c* and 1*d* there is provided a connection element 8, 8' which protrudes in the lengthwise direction of the channel and extends over approximately one-half of the circumference of the related channel section 1*a*, 1*b*, 1*c* and 1*d*, as the case may be. The connection elements 8, 8' are formed by a sheet metal strip which is secured at the channel inner side or interior 1' at the related channel sections, for instance by spot welding. During assembly of neighboring channel sections 1*a*, 1*b*, 1*c*, 1*d* the protruding part of each connecting or connection element 8, 8' engages into the other channel section, as particularly well seen by referring to FIGS. 3 and 4 based upon channel sections 1*a* and 1*b*. The connection element 8 which is secured at the channel section 1*a*, then is located at the inside of the channel section 1*b*, whereas the connection element 8' of this channel section 1*b* then bears at the inner side of the channel section 1*a*. The joint location of two channel sections is therefore essentially completely covered towards the channel interior 1' by two mutually merging connection elements 8, 8'. The joints or separation locations between both of the connection elements 8, 8' do not coincide with a fold connection 6.

Figure 5:
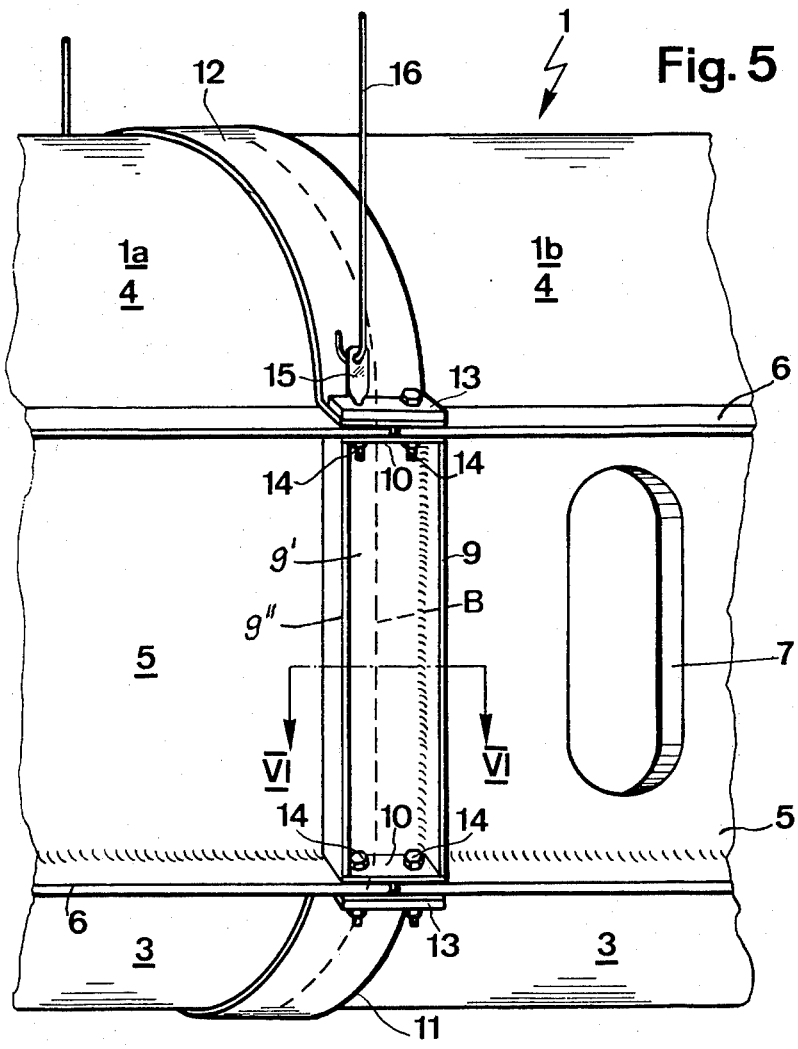
FIG. 5 is a perspective view of the region of the joint location of two channel sections.
Figure 6:
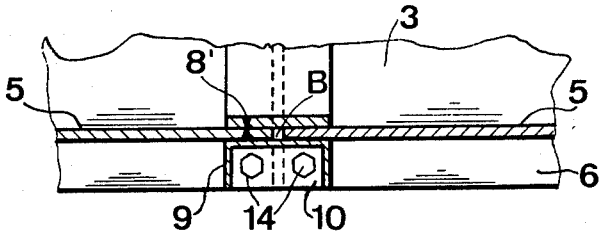
FIG. 6 is a sectional view of the arrangement of FIG. 5, taken substantially along the line VI—VI thereof.

FIGS. 5 and 6 illustrate the manner in which the individual channel sections 1*a* to 1*d* can be held together at their joint locations from the outside. At the outer side of both side wall portions 5 there bear the U-shaped profiles 9 by means of their profile webs 9' which cover the joint B. At both ends the U-shaped profiles 9 possess plates 10 which extend between the profile flanges 9'' and are connected with the U-shaped profiles or profile elements 9, for instance by welding. These plates or plate members 10 bear upon the fold connections 6. At the outer side of the base portion 3 and the ceiling or roof portion 4 there bears a respective reinforcement band 11 and 12, each of which covers the joint B. The ends of each reinforcement band 11 and 12 is fixedly retained between a fold connection 6 and a clamping plate 13. By means of threaded bolts or screws 14, which piercingly extend through the related plate 10, the fold or crimp connection 6, the end of the reinforcement bands 11, 12 and the clamping plate 13, the clamping plates 13 are connected with the plates 10. The bolt heads 15 of the threaded bolts or screws 14 or equivalent structure of the upper clamp connection is structured as an eyelet at which there can be suspended a suspension element 16. By means of these suspension elements 16 it is possible to suspend the inflow or infeed channel 1, for instance at the ceiling of the room or area which is to be climatized. The U-shaped profiles 9 and the reinforcement bands 11 and 12 can be provided with a sealing element at their underside confronting the channel 1, this sealing element bearing against the joint B and sealing the channel interior 1' towards the outside. However, it is also possible to fill such joint B with a suitable sealing material which is protected by the U-shaped profile 9 located thereover and the reinforcement bands 11, 12.

Figure 7:
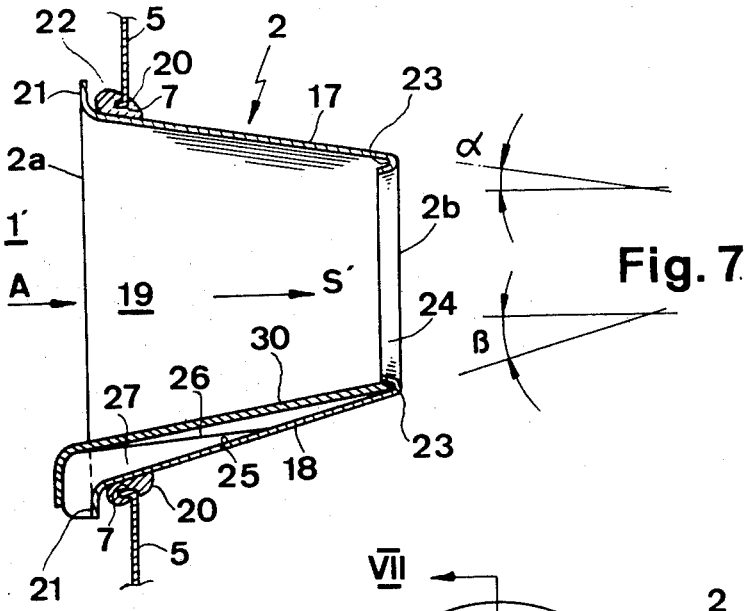
FIG. 7 illustrates an outlet or discharge element in longitudinal sectional view, taken substantially along the line VII—VII of FIG. 8.
Figure 8:
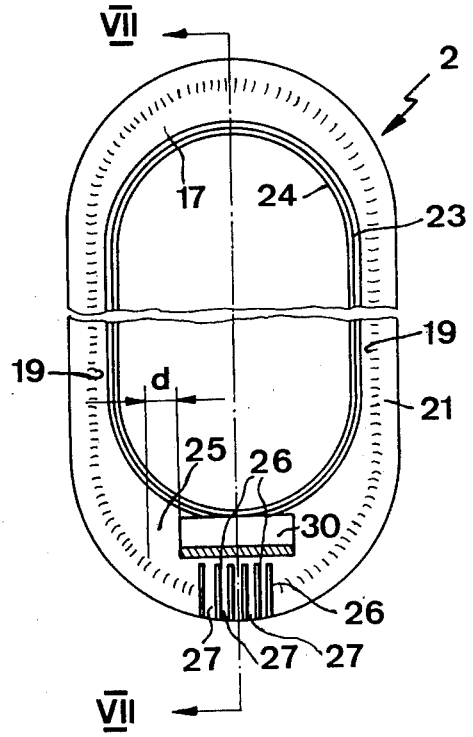
FIG. 8 is an end view of the outlet or discharge element shown in FIG. 7, looking in the direction of the arrow A thereof.

From the showing of FIGS. 7 and 8 there will be recognized the construction of the outlet or discharge elements 2. These outlet elements 2 likewise possess an upright oval cross-sectional configuration or cross-section and taper from the inlet opening 2*a* towards the outlet opening 2*b*. The throughflow cross-section decreases continuously in the flow direction S'. Both the roof or ceiling portion 17 and also the base or floor portion 18 of the outlet elements 2 are curved or domed and are formed by jacket sections of truncated cones, preferably circular truncated cones. As particularly well evident by referring further to FIGS. 7 and 8 the truncated cone correlated with the base portion 18 has a larger aperture angle than the truncated cone correlated with the roof or ceiling portion 17, which in turn results in the base portion 18 having a greater inclination than the roof or ceiling portion 17. The roof or ceiling portion 17 and the base portion 18 are interconnected by substantially planar or flat side wall portions 19 which are formed of one-piece with the ceiling portion 17 and base portion 18. The outlet or discharge elements 2 are inserted into the openings 7 provided at the side wall portion 5 of the infeed channel 1. As also will be recognized by further reverting to FIG. 7, at the edge of the side wall portion 5, limiting the openings 7, there is secured a profile element 20 which extends along the entire circumference of the related opening 7. This profile element or profile 20 fixedly retains the outlet element 2 which has been inserted through the related opening 7. The end portion 21 of the inlet-side end of the outlet element 2 which protrudes into the channel interior or internal space 1' is outwardly or upwardly flexed so as to extend towards the outside of the outlet or discharge element 2. This upwardly drawn or flexed end portion or section 21 is located in spaced relationship from the channel side wall portion 5, so that between such end section 21 and the side wall portion 5 there is formed a catch trough or groove 22. Within the catch trough 22 there is caught the water which flows as a film along the inner surface or wall 1'' of the side wall portion 5 and is laterally downwardly discharged at the outlet elements 2. In this way there is prevented that water which deposits upon the inner surface 1'' of the infeed channel 1 will become entrapped by the air flow which effluxes through the outlet or discharge elements and will be entrained by such airflow.

FIG. 9 illustrates the resilient tongue 20*a* of the profile element 20 while FIG. 10 illustrates cover 31 with its throughpass means 32.

At the outlet side 2*b* of the outlet element 2 there is provided a catch trough 23 which is open towards the channel interior 1'. This catch trough 23 extends at the inner surface 2' of the outlet element 2 along the entire circumference of the outlet opening 2*b*. This catch trough 23 is formed by an inwardly directed outlet-side end section or portion 24 of the outlet element 2. By means of this catch trough 23 there is prevented that water which has separated at the inner surface or wall 2' of the outlet element 2 can reach the region of the outlet opening 2*b*, where it could be entrained by the effluxing airflow.

Both the water which has deposited at the inner surface 2' of the outlet element 2 and also the water which has been collected in the catch trough 23 flows in the form of a film to the base or floor portion 18 which serves as a collecting trough 25, which, as already explained, descends towards the channel interior 1'. The water which collects within the collection trough 25 therefore is returned by the collecting trough 25 back into the internal space or interior 1' of the channel 1.

Now in order to prevent that droplets will be entrained out of the water flowing back through the collecting trough 25 by the air current or flow in the infeed channel 1 and in the outlet or discharge elements 2, there are provided at the region of the inlet opening 2*a* of the outlet elements 2 a number of ribs 26 which protrude upwardly from the base portion 18. These mutually parallel ribs 26, extending essentially in the flow direction S', form therebetween individual return flow channels or gutters 27 in which the collected water can flow back while being protected from the flowing air. As best seen by referring to FIG. 7 these ribs 26 or equivalent structure protrude past the inlet opening 2*a* into the channel interior 1'. However, it is also possible to construct the ribs 26 so that they are not in the form of protruding elements and to have them terminate at the plane of the inlet opening 2*a*.

The water which has been returned back by the collecting troughs 25 of the outlet or discharge elements 2 as well as the water film which flows downwardly at the inner surface 1'' of the infeed channel 1 is collected at the base portion 3 constructed as a collecting trough (FIGS. 1 and 3) of the infeed channel 1 and returned back in countercurrent flow with respect to the flow direction S.

Due to the described construction of the infeed channel 1 and the outlet or discharge elements 2 there is effectively prevented that by virtue of the action of the effluxing airflow there will be entrained large water droplets, which when admixing with the unsaturated ambient air will not evaporate and will tend to deposit at a suitable location, for instance at machines, equipment, materials or goods and the like. Since in the flow cross-section there are not incorporated any water separation elements, the airflow is not effected to any great degree and there is not hindered the efflux of small water droplets.

Additionally, the construction of the infeed or inflow channel 1 and the outlet or discharge elements 2 allows for a favorable fabrication of the individual parts as well as a simple final assembly at the site of erection. The base portion 3, ceiling or roof portion 4 and the side wall portions or parts 5 are separately fabricated and subsequently assembled by means of the fold or crimp connections 6 into the individual channel sections or portions 1*a*, 1*b*, 1*c*, 1*d*. Thereafter, the connection elements 8, 8' are mounted and the profile elements 20 are inserted into the openings 7. The outlet or discharge elements 2, which for instance can be constructed as molded parts formed of rubber or suitable plastics material, can be separately fabricated. Due to the taper of the infeed channel 1 the individual channel sections or portions 1*a*, 1*b*, 1*c* and 1*d* can be telescoped or inserted into one another for transport purposes, as the same has been shown in broken lines in FIG. 2. Hence, the requisite transport space or volume can be maintained small. At the site of erection the individual channel sections 1*a*, 1*b*, 1*c* and 1*d* can be joined together and at the joints there can be mounted the U-shaped profiles or profile members 9 and the reinforcement bands 11 and 12, which are then connected with one another by the screws or threaded bolts 14 and with the infeed channel 1.

The outlet elements 2 can be inserted from the outside of the infeed channel 1 into the openings 7. Since the length of the outlet or discharge elements 2 in the flow direction S' is smaller than the height of the openings 7, the outlet elements 2 together with their openings 2*a* and 2*b* situated at the bottom and top, can be inserted while slightly pressing the side wall portions 19 from the outside through the openings 7 into the interior or internal space 1' of the inflow channel 1. After appropriately rotating the outlet elements 2 the latter can be displaced from the channel interior 1' through the openings 7 towards the outside until they are fixedly seated upon the profile elements 20. The outlet elements 2 therefore, following their mounting, also can be easily removed without any complicated manipulations or working operations, which, in turn, facilitates the cleaning and maintenance of the equipment.

It should be understood that the illustrated air distribution apparatus can have different parts thereof constructed differently than shown and disclosed herein by way of example and not limitation. For instance, the cross-section of both the inflow or infeed channel 1 as well as the outlet or discharge elements 2 can have a different shape than an oval configuration. The ceiling or roof portion 4 of the inflow channel 1, instead of being domed or arched, also can have a flat configuration, and in such case the ceiling portion can ascend at an inclination towards one channel side wall 1'' in the manner of a desk top. However, it is also conceivable to have the roof or ceiling portion 4 constructed so as to descend towards both sides of the inflow channel 1 in the form of a desk top.

It equally would be possible to cover the collecting channel 28 at the base portion 3 of the inflow channel 1 in a suitable manner, in order to avoid any entrainment of the water droplets out of the return flowing water. This covering should be designed such that the water which precipitates at its top surface can flow downwardly into the collecting trough 28. Of course, such covering should not hinder flow of water back into the collecting trough 28 and which flows downwardly along the inner surface of the inflow channel 1.

The outlet or discharge elements 2 can also be mounted from the outside at the channel side wall portions 5 and can be connected therewith in any suitable fashion. The collecting trough 22, which with the illustrated exemplary embodiment is constructed in part by the end portion or section 21 of the related outlet or discharge element 2, also can be constructed as a component which is separated from the outlet elements 2. Instead of providing the ribs 26 it is also possible to provide a covering serving the same purpose and serving for covering or closing the collecting trough 25. During the construction of such covering or cover care must be likewise taken to ensure that the return flow of the separated water into the collecting trough 25 is not hindered.

The described distributor apparatus also can be used for guiding air which is not oversaturated. Also in this case there is effectively prevented that the water which possibly has been separated out at the inner surface of the collecting channel and at the outlet or discharge elements will be entrained by the airflow.

While there are shown and described present preferred embodiments of the invention, it is to be distinctly understood that the invention is not limited thereto, but may be otherwise variously embodied and practiced within the scope of the following claims. Accordingly,

What I claim is:

1. An air distribution apparatus comprising:

inflow channel means;

outlet elements provided at least at one side of said inflow channel means and distributed over the length of said at least one side of said inflow channel means;

each of said outlet elements having a base portion for receiving water which has been separated out of air flowing through said inflow channel means;

each of said outlet elements having a free flow cross-section;

each of said outflow elements having an outlet opening;

each of said outflow elements being provided with a catch element extending along the circumference of its outlet opening and serving to prevent the efflux of water precipitated at an inner surface of said outflow element;

each of said outflow elements containing a collecting trough formed by said base portion;

said collecting trough descending towards the interior of said inflow channel means;

said collecting trough serving for the withdrawal of water which has been removed at the related outlet element;

each of said outlet elements has an inlet opening;

a plurality of ribs arranged at least at the region of the inlet opening of the related outlet element;

said ribs being arranged so as to protrude from the base portion of the related outlet element and being disposed in spaced relationship from one another and extending essentially in the lengthwise direction of the related outlet element; and said plurality of ribs extend within the interior of the inflow channel means and subdivide the collecting trough into individual return flow channels.

2. The air distribution apparatus as defined in claim 1, wherein:

each outlet element has an inlet side; and each outlet element having a flow cross-section which continuously decreases from the inlet side to the outlet side of such outlet element.

3. The air distribution apparatus as defined in claim 1, wherein:

said outlet elements being retained in said openings by a clamping action.

4. The air distribution apparatus as defined in claim 1, wherein:

the inflow channel means includes a ceiling portion which is structured to descend at least towards one side wall of said inflow channel means.

5. The air distribution apparatus as defined in claim 4, wherein:

said ceiling portion is arched.

6. The air distribution apparatus as defined in claim 5, wherein:

said inflow channel means possesses a substantially oval cross-section;

said inflow channel means including side walls which interconnect the arched ceiling portion and an arched base portion of said inflow channel means;

said base portion of said inflow channel means being arched in order to serve as return flow channel means for separated water; and at least one of the side walls of the inflow channel means being provided with receiving openings for said outlet elements.

7. The air distribution apparatus as defined in claim 6, wherein:

the throughflow cross-section of the inflow channel means continuously decreases in the airflow direction.

8. The air distribution apparatus as defined in claim 1, wherein:

said inflow channel means comprises individual inflow channel sections; and said individual inflow channel sections being provided with plug connection means for interconnecting said inflow channel sections with one another at joint locations thereof.

9. The air distribution apparatus as defined in claim 8, wherein:

each inflow channel section is provided at one end thereof with a connection element protruding in the lengthwise direction of the inflow channel means; and said connection element engaging into the interior of the neighboring inflow channel section and bearing at the inner wall thereof.

10. The air distribution apparatus as defined in claim 9, wherein:

said connection element extends approximately through one-half of the periphery of the related channel section.

11. The air distribution apparatus as defined in claim 9, further including:

holder means surrounding the joint locations of the inflow channel means and secured to said inflow channel means for at least partially covering said joint locations.

12. The air distribution apparatus as defined in claim 1, wherein:

the inflow channel means includes a base portion;

said base portion of said inflow channel means being provided with return flow channel means for the water which has been separated out.

13. The air distribution apparatus as defined in claim 1, wherein:

said air distribution apparatus is used for the distribution of oversaturated air.

14. An air distribution apparatus comprising:

inflow channel means;

outlet elements provided at least at one side of said inflow channel means and distributed over the length of said at least one side of said inflow channel means;

each of said outlet elements having a base portion for receiving water which has been separated out of air flowing through said inflow channel means;

each of said outlet elements having a free flow cross-section;

each of said outflow elements having an outlet opening;

each of said outflow elements being provided with a catch element extending along the circumference of its outlet opening and serving to prevent the efflux of water precipitated at an inner surface of said outflow element;

each of said outflow elements containing a collecting trough formed by said base portion;

said collecting trough descending towards the interior of said inflow channel means;

said collecting trough serving for the withdrawal of water which has been removed at the related outlet element;

each of said outlet elements has inlet opening;

a plurality of ribs arranged at least at the region of the inlet opening of the related outlet element; and said ribs being arranged so as to protrude from the base portion of the related outlet element and being disposed in spaced relationship from one another and extending essentially in the lengthwise direction of the related outlet element.

* * * * *